United States Patent [19]

Holden

[11] Patent Number: 5,032,920

[45] Date of Patent: Jul. 16, 1991

[54] GROUND STRAP FOR CONDUCTIVE SCREEN ON CRT

[75] Inventor: Thomas E. Holden, Rocklin, Calif.

[73] Assignee: Hewlett-Packard Company, Palo Alto, Calif.

[21] Appl. No.: 400,249

[22] Filed: Aug. 29, 1989

[51] Int. Cl.[5] ..... H04N 5/65

[52] U.S. Cl. ..... 358/252; 358/250

[58] Field of Search ..... 358/245, 246, 247, 252, 358/253, 255, 250; 174/35 R

[56] References Cited

U.S. PATENT DOCUMENTS

| | | | |
|---|---|---|---|
| 4,468,702 | 8/1984 | Jandrell | 358/245 |
| 4,661,856 | 4/1987 | Schnack | 358/252 |
| 4,686,576 | 8/1987 | Dickie et al. | 358/253 |
| 4,710,591 | 12/1987 | Rochester, Jr. | 358/245 |
| 4,760,456 | 7/1988 | Liang | 358/245 |
| 4,853,790 | 8/1989 | Dickie | 358/245 |

FOREIGN PATENT DOCUMENTS

| | | | |
|---|---|---|---|
| 0571013 | 8/1977 | U.S.S.R. | 358/245 |
| 8903631 | 4/1989 | World Int. Prop. O. . | |

*Primary Examiner*—Joseph A. Orsino
*Assistant Examiner*—Jerome Grant

[57] ABSTRACT

A device which provides electrical grounding between a conductive screen and a cathode ray tube (CRT) mounted in a monitor includes a conductive piece which is electrically connected to the conductive screen. When the conductive screen is mounted over the CRT the conductive piece exerts a spring force on a conductive strap on the CRT, thus establishing electrical connection between the conductive piece and the CRT. A coating of electrically conducting paint may also be used to facilitate conduction between the conducting piece and the conductive strap.

8 Claims, 2 Drawing Sheets

GROUND STRAP FOR CONDUCTIVE SCREEN ON CRT

BACKGROUND

The present invention concerns the grounding of a conductive screen to a cathode ray tube (CRT) in a monitor.

An electrostatic field is created outside the face of a CRT by high voltage that is produced by a mask on the CRT's inner face. One method to minimize this electrostatic field includes the application of a conductive coating to the face of a CRT during manufacture. This coating is made part of the ground potential.

Another method to minimize the electrostatic field outside of the face of a CRT is to add on a conductive screen. Such a conductive screen is typically made from a fine mesh conductive material that will pass a high percentage of light. The fine mesh screen is attached to and stretched by a rigid frame. The mesh is attached to the CRT ground potential.

Often the conductive screens are sold separately from a monitor and may be installed by a user. A user mechanically attaches the rigid frame to the bezel of a monitor. The conductive screen is then typically grounded with a wire which is attached to the conductive screen, for example, by solder or epoxy. The other end of the wire is attached by a screw somewhere on the chassis of the CRT. If the wire is short, the wire usually is not attachable unless the bezel is removed. In this case, in order to facilitate attaching the screw to ground, part of the bezel of the monitor needs to be disassembled. When the screw has beem tightened the bezel is reassembled. Disassembly of the bezel may be avoided if the wire is long enough so that it may be attached at the rear of the monitor. In this case, however, a wire may be exposed over a least a part of the lenght of the CRT.

SUMMARY OF THE INVENTION

In accordance with the preferred embodiment of the present invention a device is presented which provides electrical grounding between a conductive screen and a cathode ray tube (CRT) ground potential when mounted in a monitor. The device includes a conductive piece which is electrically connected to the conductive screen. When the conductive screen is mounted over the CRT the conductive piece exerts a spring force on a conductive strap on the CRT, thus establishing electrical connection between the conductive piece and the CRT. A coating of electrically conducting paint may also be used to facilitate conduction between the conducting piece and the conductive strap.

The present invention allows connection of the conductive screen to the CRT without the necessity of disassembly of the bezel and without leaving exposed wires in the monitor.

DESCRIPTION OF THE PREFERRED EMBODIMENT

Figure 1:
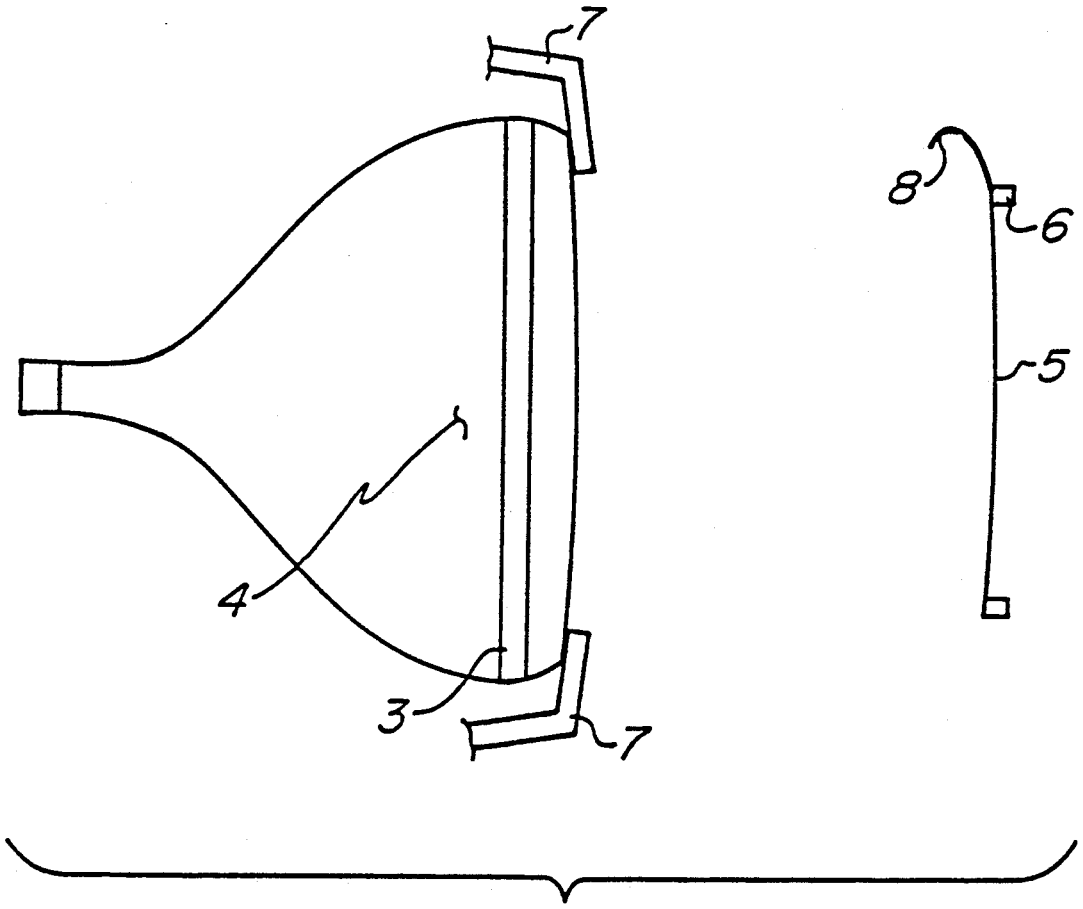
FIG. 1 shows a conductive screen before mounting into a CRT monitor in accordance with the preferred embodiment of the present invention.

In FIG. 1, a CRT monitor is shown. The monitor includes a bezel 7 and a CRT 1. A conductive screen 5 typically includes a fine wire mesh. Conductive screen 5 is attached to bezel 7 using a frame 6.

A conductive piece 8 is used to ground conductive screen 5 to CRT 1. Conductive piece 8 is for instance a thin strip of spring beryllium copper or stainless steel. Conductive piece 8 is placed in electrical contact with conductive screen 5, for example by attaching conductive piece 8 to frame 6 using a screw or rivet or some other means.

Figure 2:
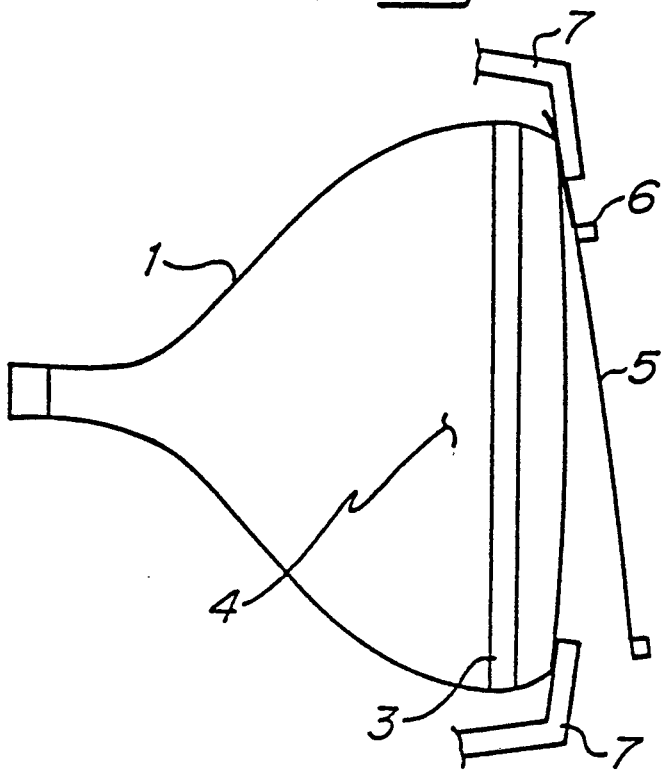
FIG. 2 shows the conductive screen shown in FIG. 1 during mounting into the CRT monitor in accordance with the preferred embodiment of the present invention.

FIG. 2 shows conductive screen 5 with frame 6 being installed. Conductive piece 8 is deformed straight in order to allow for insertion between bezel 7 and CRT 1.

Figure 3:
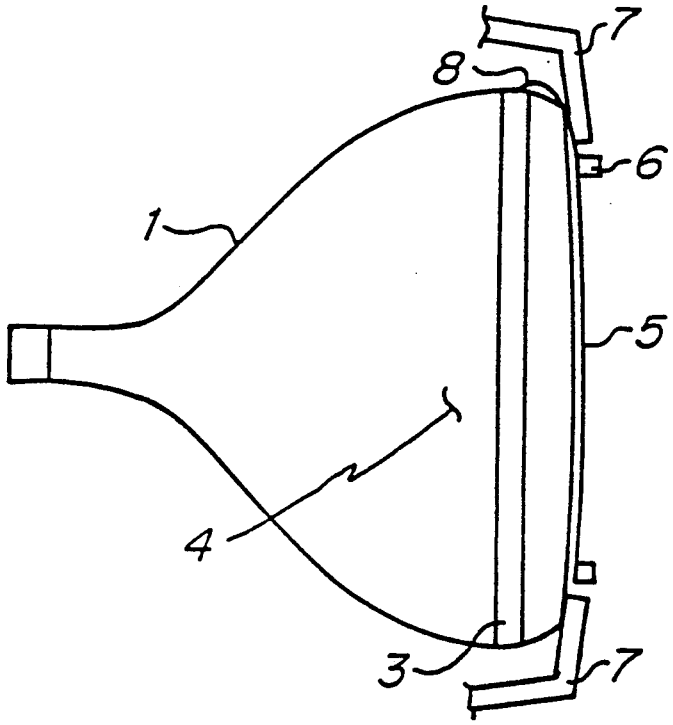
FIG. 3 shows the CRT monitor shown in FIG. 1 after mounting of the conductive screen in accordance with the preferred embodiment of the present invention.

As shown in FIG. 3, conductive piece 8 is bent so that when conductive screen 5 is mounted on the monitor chassis, conductive piece 8 exerts spring pressure against a ground strap 3 on CRT 1 creating an electromechanical connection. A coating of electrically conducting paint may also be used to facilitate conduction between conductive piece 8 and ground strap 3.

I claim:

1. In a monitor on which is mounted a conductive screen, a device for grounding the conductive screen to a cathode ray tube in the monitor, the device comprising:

a conductive piece, electrically coupled to the conductive screen, which when the cathode ray tube is mounted in the monitor exerts a spring force on the cathode ray tube establishing electrical connection between the conductive piece and the cathode ray tube.

2. A device as in claim 1 wherein the cathode ray tube includes an independent ground strap fastened to the cathode ray tube so that a portion of the ground strap is at a location on the cathode ray tube where electrical connection is established between the conductive piece and the cathode ray tube.

3. A device as in Claim 2 wherein a coating of electrically conducting paint is placed over the location on the cathode ray tube where electrical connection is established between the conductive piece and the cathode ray tube.

4. A device as in claim 1 wherein a coating of electrically conducting paint is placed over a location on the cathode ray tube where electrical connection is established between the conductive piece and the cathode ray tube.

5. A method for grounding a conductive screen mounted on a monitor to a cathode ray tube the method comprising the steps of:

(a) electro-mechanically connecting a conductive piece to the conductive screen, the conductive piece shaped so that upon mounting the conductive screen on the monitor the conductive piece will exert a spring force on the cathode ray tube establishing electrical connection between the conductive piece and the cathode ray tube; and (b) mounting the conductive screen on the monitor.

6. A method as in claim 5 wherein before step (b) the following step is performed:

(c) fastening a ground strap to the cathode ray tube so that a portion of the ground strap is at a location on the cathode ray tube where electrical connection is established between the conductive piece and the cathode ray tube.

7. A method an in claim 6 additionally comprising the following step:

(d) placing a coating of electrically conducting paint over the location on the cathode ray tube where electrical connection is stablished between the conductive piece and the cathode ray tube.

8. A method as in claim 5 additionally comprising the following step:

(d) placing a coating of electrically conducting paint over a location on the cathode ray tube where electrical connection is established between the conductive piece and the cathode ray tube.

* * * * *